US005253028A

United States Patent [19]

Gonda et al.

[11] Patent Number: 5,253,028

[45] Date of Patent: Oct. 12, 1993

[54] IMAGE FORMING APPARATUS HAVING A PLURALITY OF VERTICALLY STACKED IMAGE FORMING UNITS AND PROVIDING EASILY CONDUCTED JAM CLEARING AND MAINTENANCE

[75] Inventors: Takashi Gonda, Aichi; Hirofumi Hasegawa, Hadano; Motohiro Yamada, Okazaki; Takayuki Ariyama, Toyokawa, all of Japan

[73] Assignee: Minolta Camera Kabushiki Kaisha, Osaka, Japan

[21] Appl. No.: 729,078

[22] Filed: Jul. 12, 1991

[30] Foreign Application Priority Data

Jul. 12, 1990 [JP] Japan ..... 2-186835

[51] Int. Cl.[5] ..... G03G 21/00

[52] U.S. Cl. ..... 355/309; 271/9; 271/902; 355/319; 355/321

[58] Field of Search ..... 355/308, 309, 318, 319, 355/321, 200; 271/3, 186, 902, 9

[56] References Cited

U.S. PATENT DOCUMENTS 4,754,293 6/1988 Aizawa et al. ..... 271/186 X
4,972,236 11/1990 Hasegawa ..... 355/319
4,972,236 11/1990 Hasegawa ..... 355/319
5,001,516 3/1991 Maruyama ..... 355/202
5,002,266 3/1991 Kukuchi et al. ..... 271/3

FOREIGN PATENT DOCUMENTS 59-133577 7/1984 Japan ..... 355/309
61-56371 3/1986 Japan .
1-295283 11/1989 Japan ..... 355/308

*Primary Examiner*—A. T. Grimley
*Assistant Examiner*—Shuk Y. Lee
*Attorney, Agent, or Firm*—Willian Brinks Olds Hofer Gilson Lione

[57] ABSTRACT

A paper feed path is formed along a substantially vertical plane whereby a transfer sheet is subsequently passed through image forming units vertically stacked for subsequent image forming process in each image forming unit. An opening and closing portion of each image forming unit is separated from a main body portion by the paper feed path and is arranged to move about the vertical rotating axis on one side of the paper feed path to open and close the paper feed path in the horizontal direction irrelevant to the vertical stack of the image forming units.

20 Claims, 4 Drawing Sheets

IMAGE FORMING APPARATUS HAVING A PLURALITY OF VERTICALLY STACKED IMAGE FORMING UNITS AND PROVIDING EASILY CONDUCTED JAM CLEARING AND MAINTENANCE

BACKGROUND OF THE INVENTION

1. Technical Field of the Invention

The present invention relates to an image forming apparatus such as printers.

2. Description of Related Art

In recent years, there has been a growing demand for printers to be more sophisticated by adding such various functions as double-side printing function, composite printing function, and color printing function. On the other hand, a compact and inexpensive apparatus is also required though it is provided with only a single function. However, for such an apparatus with a single function, there is not prepared any optional unit of the above-mentioned functions to be attached to the apparatus. The user who has been using a printer which is provided with a single function is, therefore, obliged to prepare a high-grade apparatus besides the apparatus of a single function when it becomes necessary for the user to utilize sophisticated functions.

In constructing a high-grade printer, it may advantageously be arranged to provide a versatile printer with various functions basing on the inexpensive printer with a single function, however, such a printer has not been proposed yet.

In U.S. Pat. No. 4,972,236, there is disclosed an image forming apparatus wherein a plurality of image forming units are combined. In the apparatus, a plurality of image forming units are vertically stacked, and a paper feeding section and paper discharging section of an upper and lower image forming units are connected by a paper conveying unit provided with changeover means capable of changing over paper conveying paths. According to the image forming apparatus, double-side printing function, composite printing function, color printing function and the like may be arranged by means of conveying sheets of copy paper in various modes with the paper conveying unit. A sorting function may also be provided by utilizing the paper conveying unit which is provided with a sorter section.

In the image forming apparatus, however, when a sheet is jammed in the paper feeding path of the image forming unit and paper conveying unit other than the uppermost image forming unit and the paper conveying unit or when various maintenance operations are conducted, it is necessary to clear the jam and conduct a maintenance operation by opening upper frame of the image forming unit or opening upper cover of the paper conveying unit after each unit stacked thereabove is removed which causes the operations more complicated.

SUMMARY OF THE INVENTION

It is a primary object of the present invention to provide an image forming apparatus wherein a plurality of image forming units with a single function are vertically stacked to have various functions, and jam clearing and maintenance operations can be easily conducted.

Another object of the present invention is to provide an image forming apparatus wherein jam clearing and maintenance operations can be easily conducted even if the units are vertically stacked for arrangement of various functions with a simple improvement of changing the direction of paper feed path in an image forming unit and changing the direction of opening and closing actions by utilizing the path.

These and other objects and features of the present invention will become more apparent from the following description taken in conjunction with the accompanying drawings which illustrate specific embodiments of the invention.

BRIEF DESCRIPTION OF THE DRAWINGS

It is to be noted that like parts are designated by like numerals in each embodiment, and repeated description is omitted.

DESCRIPTION OF THE PREFERRED EMBODIMENTS

Some of the embodiments of the present invention will now be described referring to the accompanying drawings.

Figure 1:
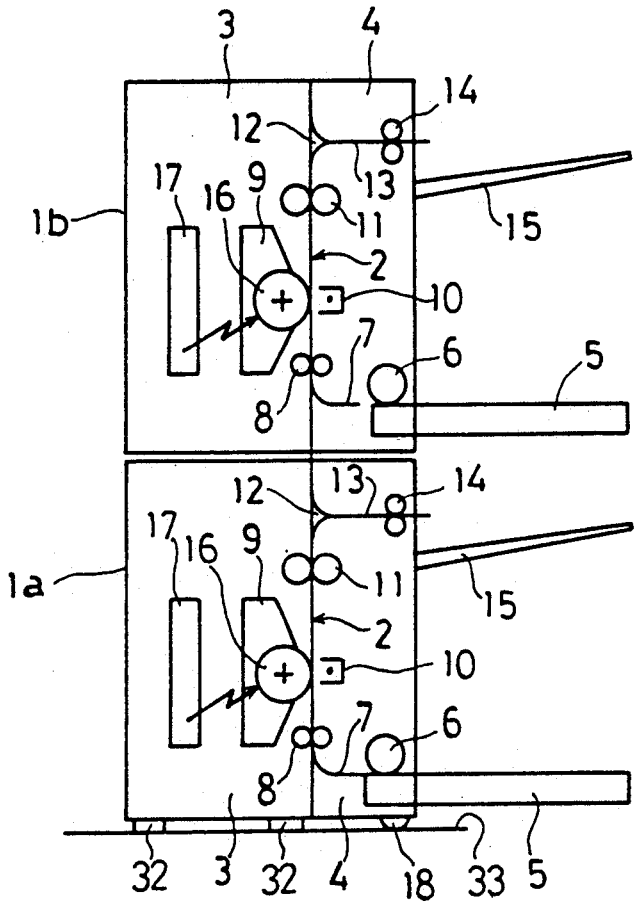
FIG. 1 is a schematic structural view showing an image forming apparatus to which the- present invention is applied as first embodiment.
Figure 2:
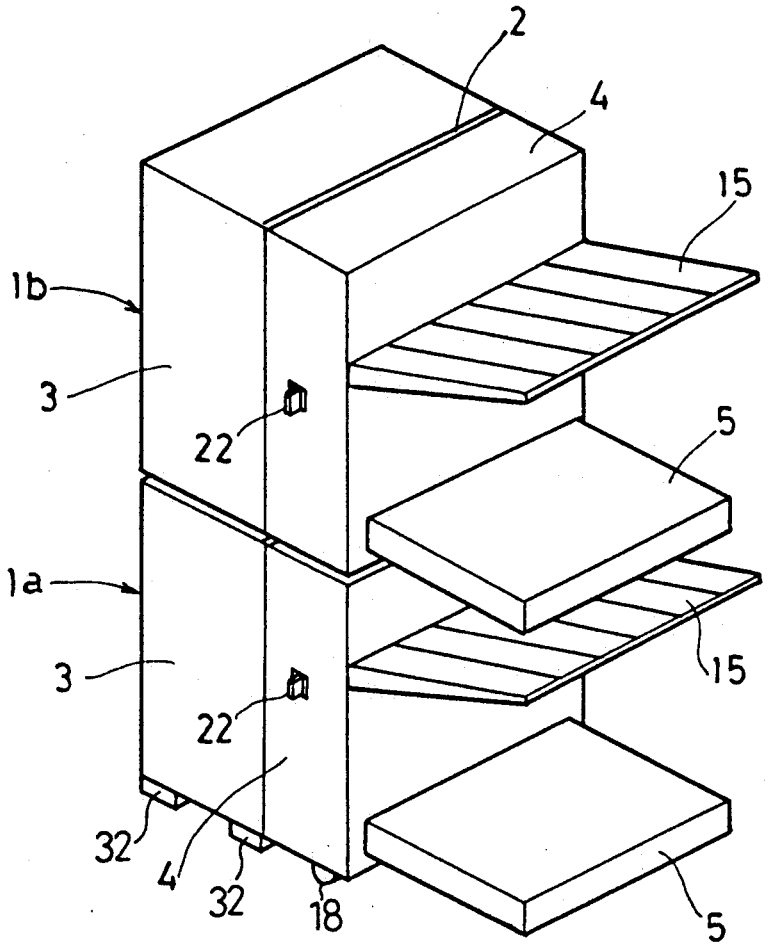
FIG. 2 is an exterior perspective view showing an image forming apparatus.
Figure 3:
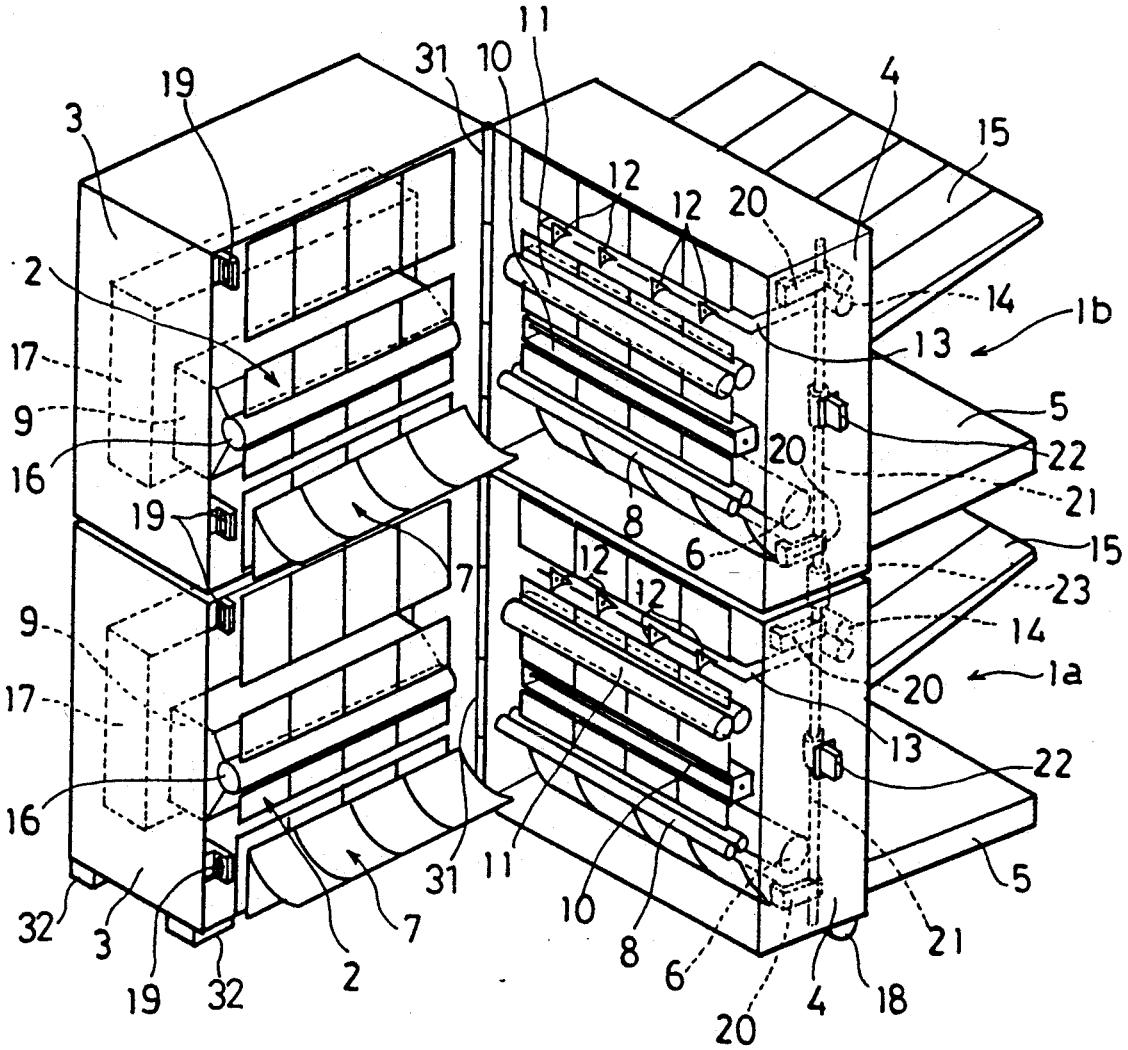
FIG. 3 is a perspective view showing an image forming apparatus wherein a paper feed path is opened.

FIGS. 1 through 3 show an image forming apparatus to which the present invention is applied as a first embodiment.

As illustrated in FIGS. 1 and 2, image forming units 1*a* and 1*b* are stacked vertically. The units are small-sized paper printers equipped with a single function. In each of the units 1*a* and 1*b*, there is provided a paper feed path 2 along a substantially vertical plane, and main body portion 3 and opening-closing portion 4 are divided and facing each other with the paper feed path 2 therebetween. As shown in FIG. 3, the opening-closing portion 4 is connected to the main body portion 3 with a hinge 31 at one side of the paper feed path 2, and with a rotation of the hinge 31 around its vertical axis, the paper feed path 2 is opened and closed.

At the lower portion of each opening-closing portion 4, there are provided a paper feed cassette 5 and paper feed roller 6, and a paper feed path 7 extending from the paper feed cassette 5 is connected to the lower portion of the paper feed path 2. In the paper feed path 2, there are subsequently disposed upward from the connecting section of the paper feed path 7, a register roller 8, an image forming cartridge 9 and a transfer charger 10, a fixing roller 11 and a changeover claw 12.

At the upper portion of each opening-closing portion 4, a paper discharge path 13 is provided to be connected with the paper feed path 2 through the changeover claw 12, and a paper discharge roller 14 and a paper discharge tray 15 are disposed. The image forming cartridge 9 is provided on the side of the main body portion 3 and the transfer charger 10 on the side of the opening-closing portion 4. The image forming cartridge 9 is integrally constructed with a photoconductive drum 16, unillustrated electrifying means, developing means and cleaning means, and an image is exposed onto the photoconductive drum 16 by an optical system unit 17 disposed on the side of the main body portion 3 to form an electrostatic latent image. The latent image is then developed with toner by the developing means to be transferred onto a transfer sheet by the transfer charger 10.

The optical system unit 17 is arranged to deflect the laser beam irradiated from a semiconductor laser which is modulated by an unillustrated image control section by deflecting means such as polygon mirror and form an image on the photoconductive drum 16 through a correcting lens and a folding mirror by performing main scanning. The photoconductive drum 16 is rotatively driven for a subscanning movement so that the image exposure is accomplished.

At four corners of the undersurface of the main body portion 3 of the lower image forming unit 1*a*, there are provided legs 32 to stably place the main body portion 3. At the undersurface of the opening-closing portion 4 which is connected to the main body portion 3, there is provided a support roller 18 to support the opening-closing portion 4. Since the opening-closing portion 4 is connected with and supported by the main body portion 3, it is stably opened and closed with the support of the support roller 18. The support roller 18 rolls on the surface 33 (refer to FIG. 1) on which the apparatus is placed so that the opening and closing of the portion 4 can be smoothly performed.

At the opening-closing end portion of the main body portion 3, engaging members 19 are provided at two locations, upper and lower portions, and corresponding to the engaging members 19, two lock claws 20 are provided at two locations of upper and lower portions of the opening-closing portion 4. The lock claws 20 are connected with n operating shaft 21 which is provided with an operating piece 22 arranged in the middle of the shaft. The upper and lower ends of the operating shafts 21 in the lower and upper image forming units 1*a* and 1*b* are further connected to each other with a connecting metal 23 so that both of the opening-closing portions 4 are correlatively opened and closed.

Description will now be made on printing operations.

In the case where a printing operation is performed on one side of a transfer sheet, a transfer sheet is fed from the paper feed cassette 5 to the paper feed path 2 by the paper feed roller 6 passing through the paper feed path 7 in either lower or upper image forming unit 1*a*, 1*b*, and is further fed to the location between the photoconductive drum 16 and the transfer charger 10 in a synchronous timing with an image forming process by the register roller 8 in the image forming cartridge 9, and an image formed on the photoconductive drum 6 is transferred onto the transfer sheet. The image transferred onto the transfer sheet is fixed by the fixing roller 11, and the sheet is guided to the side of the paper discharge path 13 by the changeover claw 12 and is then discharged onto the paper discharge tray 15 by the paper discharge roller 14.

In the case where a composite printing or a two-color printing operation is performed, a transfer sheet is fed from the paper feed cassette 5 of the lower image forming unit 1*a*, and a first colored-image is transferred and fixed on the transfer sheet in the lower image forming unit 1*a* in the same manner as described above. The transfer sheet on which the first coloredimage is transferred is further transported upward in the paper feed path 2 by the changeover claw 12 and forwarded into the paper feed path 2 of the upper image forming unit 1*b*. A second colored-image is then formed on the first colored-image and fixed on the sheet in the upper image forming unit 1*b* in the same manner as described above. At this stage of fixing process, the toner on the first-colored image is fused again together with the toner on the second-colored image so that they are mutually mixed at the portion overlapped each other, and a composite image is thereby formed by the lower and upper image forming units 1*a* and 1*b*. There forms a two-colored image in the case where images are not overlapped each other. The transfer sheet after the transfer process is discharged onto the paper discharge tray 15 of the upper image forming unit 1*b* by the changeover claw 12 passing through the paper discharge path 13.

In the case where both-side printing is performed, a transfer sheet is fed from the paper feed cassette 5 of the lower image forming unit 1*a*, and a first formed image is transferred and fixed on a first side of the transfer sheet the lower image forming unit 1*a* in the same manner as described above, and the sheet is then guided to the side of the paper discharge path 13 by the changeover claw 12. When the rear end of the transfer sheet has passed through the changeover claw 12, the paper discharge roller 14 is reversely rotated and the changeover claw 12 is switched over to return the sheet upward in the paper feed path 12 under the state that the sheet is reversed. The sheet is forwarded as it is into the paper feed path 2 of the upper image forming unit 1*b*, and a second formed image is transferred and fixed on a second side of the transfer sheet in the upper image forming unit in the same manner as described above, and images are formed on both sides of the transfer sheet by the lower and upper image forming unit 1*a* and 1*b*. Thereafter, the sheet is discharged onto the paper discharge tray 15 of the upper image forming unit 1*b* by the changeover claw 12 passing through the paper discharge path 13.

When a maintenance or jam clearing operation is conducted for the image forming unit 1*a* and 1*b*, the engagement of the engaging member 19 with the lock claw 20 is released by operating the engaging piece 22 to open the opening-closing portion 4 as illustrated in FIG. 3. At this time, the opening-closing portions 4 of the lower and upper image forming units 1*a* and 1*b* are correlatively opened to completely open the the paper feed path 2. The maintenance and jam clearing operations can thus be conducted easily.

Figure 4:
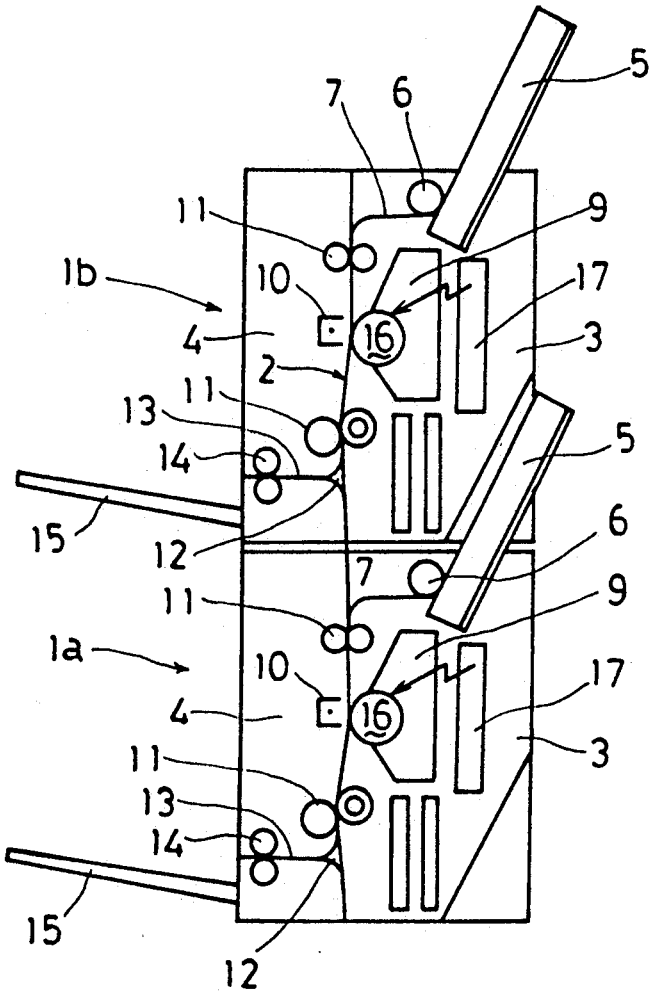
FIG. 4 is a schematic structural view showing an image forming apparatus to which the present invention is applied as a second embodiment.

A second embodiment of the present invention will now be described referring to FIG. 4.

In this embodiment, a paper feed cassette 5, paper feed roller 6 and paper feed path 7 are provided on the side of the main body portion 3 so that the weight of the opening-closing portion 4 is reduced and satisfactory weight balance of the opening-closing portion 4 can be maintained. The paper feed cassette 5 is mounted in an oblique position on the upper portion of the main body portion 3 so as to detach the cassette 5 from the front side. A transfer sheet can, therefore, be transported downward from the upper portion in the paper feed path 2.

According to each one of the embodiments of the present invention, image forming units are vertically stacked and disposed in a manner to connect each paper feed path of the units whereby the apparatus can be equipped with various functions such as both-side printing, composite printjng, and multi-color printing. Since the opening-closing portion is arranged to be opened in the horizontal direction, jam clearing and maintenance operations can be conducted easily. It is advantageous that the apparatus can be constructed simply without the necessity of interposing a sheet transport unit between the image forming units.

Further, even if a copy paper is jammed in each of the units, it can be easily cleared by providing a means for correlatively opening and closing each of the opening-closing portions under the state that image forming units are vertically stacked and disposed.

In the embodiments described above, an example has been shown wherein the image forming units are vertically stacked in two stages, however, it may also be arranged to stack the units more than three stages for forming a composite colored-image in more than three colors.

In the above embodiment, it has been shown that the paper feed path 2 is vertically passed through the lower and upper image forming units 1*a*, 1*b*, however, it may also be arranged to connect the paper feed path 2 to the paper discharge path 13 without providing the change-over claw 12 at the upper portion of the unit wherein the paper feed path 2 of the lower image forming unit 1*a* is extended upward from the paper feed path 7 with its upper portion opened and lower portion of the paper feed path 2 of the upper image forming unit 1*b* is opened. With this arrangement, the image forming units in the same construction may be utilized.

In the above described embodiment, the upper and lower opening-closing portions 4 are usually connected with the connecting member 23, however, it may also be arranged to provide a means for properly connecting and releasing the connection corresponding to a jammed location when composite printing and both-side printing are performed.

It may also be arranged to provide the opening-closing portion 4 for only a limited region in the paper feed path 2 to be opened and closed not limiting to provide the opening-closing portion 4 over the entire vertical region of each image forming unit.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus which is provided with an image forming unit wherein the image forming unit comprises:

a substantially vertical paper feed path provided along a substantially vertical plane, at least one end of the substantially vertical paper feed path being open to an upper or lower surface of the image forming unit;

image forming means provided in a midway location in the paper feed path for forming an image on a sheet being transported through the paper feed path; and an opening and closing portion which constitutes a portion facing the substantially vertical paper feed path of the image forming unit for opening and closing the paper feed path within a range it faces the path in relative movement of one side of the paper feed path about its vertical axis.

2. The image forming apparatus as defined in claim 1, further comprising:

paper feeding means positioned upstream of the image forming means in the paper feed path for automatically forwarding a sheet accommodated one by one to the paper feed path for every image forming process; and paper discharging means positioned downstream of the image forming means in the paper feed path for discharging a sheet which has completed an image forming process outside the image forming unit.

3. The image forming apparatus as defined in claim 2, wherein the paper feed path is arranged so as to pass through the image forming unit, the paper feeding means being arranged to forward a sheet to the paper feed path from the side of the paper feed path, and the paper discharging means being provided with a straight discharging mode for discharging a sheet which has completed an image forming process straight along the paper feed path and a sideward discharging mode for discharging a sheet to the side of the paper feed path.

4. The image forming apparatus as defined in claim 3, wherein a plurality of the image forming units are vertically stacked.

5. The image forming apparatus as defined in claim 3, wherein the paper discharging means further includes a switchback discharging mode for discharging a sheet straight along the paper feed path after switching back the sheet to the paper feed path once discharged to the side of the path with the sideward discharging mode.

6. The image forming apparatus as defined in claim 5, wherein the paper feeding means and a paper discharging mechanism for discharging a sheet to the side of the paper feed path in the paper discharging means are provided in the opening and closing portion.

7. The image forming apparatus as defined in claim 6, wherein a whole one side of the image forming unit which is divided into two by the paper feed path provides the opening and closing portion.

8. The image forming apparatus as defined in claim 7, wherein a plurality of the image forming units are vertically stacked.

9. The image forming apparatus as defined in claim 8, further comprising interlocking means for connecting the opening and closing portions of each image forming unit to be correlatively opened and closed.

10. The image forming apparatus as defined in claim 9, further comprising a support roller provided at a lower portion of the opening and closing portion to contact a surface on which the image forming unit is placed.

11. The image forming apparatus as defined in claim 6, wherein the paper feeding means is also provided in a main body portion which does not include the opening and closing portion of the image forming unit.

12. An image forming apparatus which is provided with a plurality of image forming units vertically stacked wherein each image forming unit comprises:

a substantially vertical paper feed path provided along a substantially vertical plane so as to pass through the image forming unit, both end portions of said substantially vertical paper feed path being opened to upper and lower surfaces of the image forming unit;

image forming means provided in a midway location in the paper feed path for forming an image on a sheet being transported through the paper feed path;

an opening and closing portion which constitutes a portion facing the substantially vertical paper feed path of the image forming unit for opening and closing the paper feed path within a range it faces the path in relative movement of one side of the paper feed path about its vertical axis;

paper feeding means positioned upstream of the image forming means in the paper feed path for automatically forwarding a sheet accommodated one by one to the paper feed path from the side of the paper feed path for every image forming process; and paper discharging means positioned downstream of the image forming means in the paper feed path having a straight paper discharging mode for discharging a sheet straight along the paper feed path after an image forming process and a sideward paper discharging mode for discharging a sheet to the side of the paper feed path.

13. The image forming apparatus as defined in claim 12, wherein the paper discharging means further includes a switchback discharging mode for discharging a sheet straight along the paper feed path after switching back the sheet to the paper feed path once discharged to the side of the path with the sideward paper discharging mode.

14. The image forming apparatus as defined in claim 13, wherein the paper feeding means and a sheet discharging mechanism for discharging a sheet to the side of the paper feed path in the paper discharging means are provided in the opening and closing portion.

15. The image forming apparatus as defined in claim 14, wherein a whole one side of the image forming unit divided into two by the paper feed path provides the opening and closing portion.

16. The image forming apparatus as defined in claim 15, further comprising interlocking means for connecting the opening and closing portions of each image forming unit to be correlatively opened and closed.

17. The image forming apparatus as defined in claim 16, further comprising a support roller provided at a lower portion of the opening and closing portion to contact a surface on which the image forming unit is placed.

18. The image forming apparatus as described in claim 17, wherein the paper feeding means is also provided in a main body which does not include the opening and closing portion of the image forming unit.

19. The image forming apparatus as claimed in claim 1 further comprising another image forming unit having the same arrangement as said image forming unit, wherein the opening of the paper feed path in said image forming unit is connectable to the opening of the paper feed path in said another image forming unit so as to transport a sheet having an image formed by the image forming means of said image forming unit to the image forming means of said another image forming unit.

20. The image forming apparatus as claimed in claim 12, wherein one of the openings of the paper feed path in one of said image forming units is connected to one of the openings of the paper feed path in another one of said image forming units so as to transport a sheet having an image formed by the image forming means of the former image forming unit to the image forming means of the latter image forming unit.

* * * * *